US008336345B2

(12) United States Patent
Burgoon

(10) Patent No.: US 8,336,345 B2
(45) Date of Patent: Dec. 25, 2012

(54) REMOTE LOCK MECHANISM FOR HANDCUFFS AND OTHER SECURITY DEVICES

(76) Inventor: Stephen T. Burgoon, Boyertown, PA (US)

( * ) Notice: Subject to any disclaimer, the term of this patent is extended or adjusted under 35 U.S.C. 154(b) by 35 days.

(21) Appl. No.: 13/089,566

(22) Filed: Apr. 19, 2011

(65) Prior Publication Data

US 2011/0259058 A1 Oct. 27, 2011

Related U.S. Application Data

(60) Provisional application No. 61/326,737, filed on Apr. 22, 2010.

(51) Int. Cl.
*E05B 75/00* (2006.01)
*E05B 35/00* (2006.01)

(52) U.S. Cl. ..... 70/16; 70/15; 70/17; 128/846; 128/869; 128/878; 128/879; 128/882

(58) Field of Classification Search ..... 70/15–17; 128/846, 869, 878, 879, 882
See application file for complete search history.

(56) References Cited

U.S. PATENT DOCUMENTS

| | | | | | |
|---|---|---|---|---|---|
| 628,139 | A * | 7/1899 | Cumming | ..... | 70/16 |
| 870,871 | A * | 11/1907 | Eggleton | ..... | 70/16 |
| 1,014,118 | A * | 1/1912 | Carberry | ..... | 70/16 |
| 1,157,135 | A * | 10/1915 | Wesson et al. | ..... | 70/16 |
| 2,516,878 | A * | 8/1950 | Howe | ..... | 70/16 |
| 2,759,349 | A * | 8/1956 | McKee | ..... | 70/16 |
| 2,772,553 | A * | 12/1956 | Howe | ..... | 70/16 |
| 2,948,139 | A * | 8/1960 | Howe | ..... | 70/16 |
| 4,287,731 | A * | 9/1981 | Kruger | ..... | 70/16 |
| 4,314,466 | A * | 2/1982 | Harris | ..... | 70/16 |
| 4,574,600 | A * | 3/1986 | Moffett | ..... | 70/16 |
| 5,463,884 | A * | 11/1995 | Woo et al. | ..... | 70/16 |
| 5,660,064 | A * | 8/1997 | Ecker et al. | ..... | 70/16 |
| 5,743,117 | A * | 4/1998 | Woo et al. | ..... | 70/16 |
| 6,619,077 | B1 * | 9/2003 | Robinson | ..... | 70/16 |
| 6,672,116 | B1 | 1/2004 | Hilliard | ..... | 70/16 |
| 7,062,943 | B2 * | 6/2006 | Parsons et al. | ..... | 70/16 |
| 7,251,964 | B2 * | 8/2007 | Wade | ..... | 70/16 |
| 7,316,136 | B2 | 1/2008 | Parsons | ..... | 70/16 |

* cited by examiner

*Primary Examiner* — Suzanne Barrett
*Assistant Examiner* — Ifeolu Adeboyejo
(74) *Attorney, Agent, or Firm* — Miller Law Group, PLLC

(57) ABSTRACT

A remote lock mechanism for a handcuff allows the unlocking of the handcuff by insertion of the key in the remote lock mechanism. The remote lock mechanism is located adjacent the pivot connecting the movable jaw of the handcuff to the fixed jaw and, thus, can be operated when the handcuffs are used to restrain a person without the officer's hands being placed between the wrists of the person being restrained. The motion corresponding to the rotation of the key in the remote lock mechanism is transferred to the handcuff lock mechanism to retract the ratchet pawl away from the movable jaw of the handcuff. In one embodiment, the remote lock mechanism utilizes a tumbler that causes opposing rotation of the conventional lock mechanism to first release the double lock mechanism and then retract the ratchet pawl with opposing rotations of the key in the remote lock mechanism.

18 Claims, 10 Drawing Sheets

Fig. 3
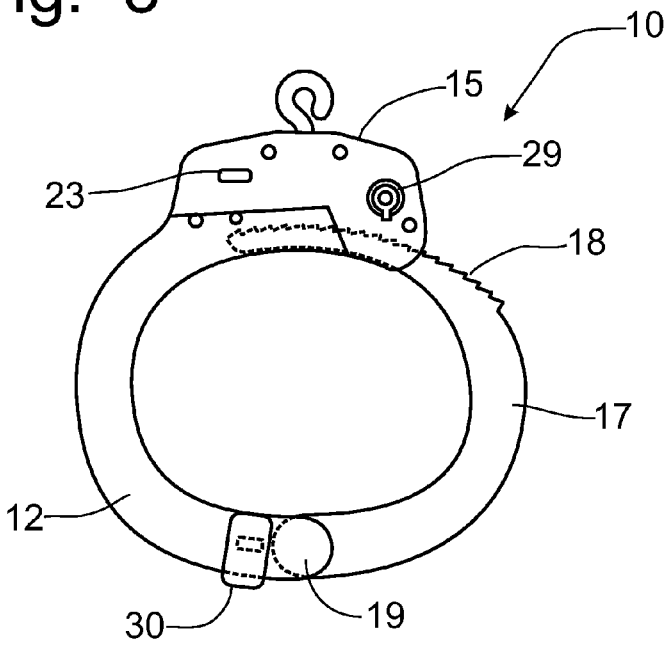
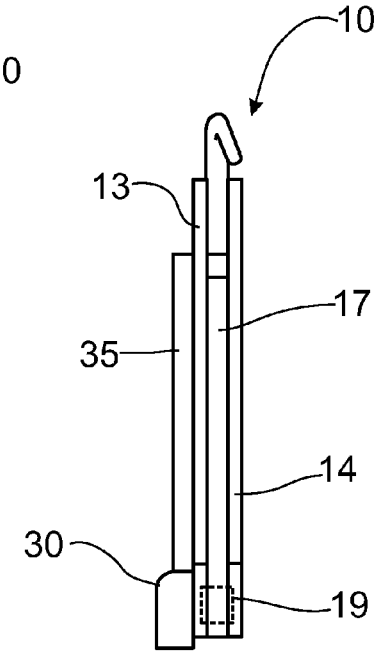
Fig. 4
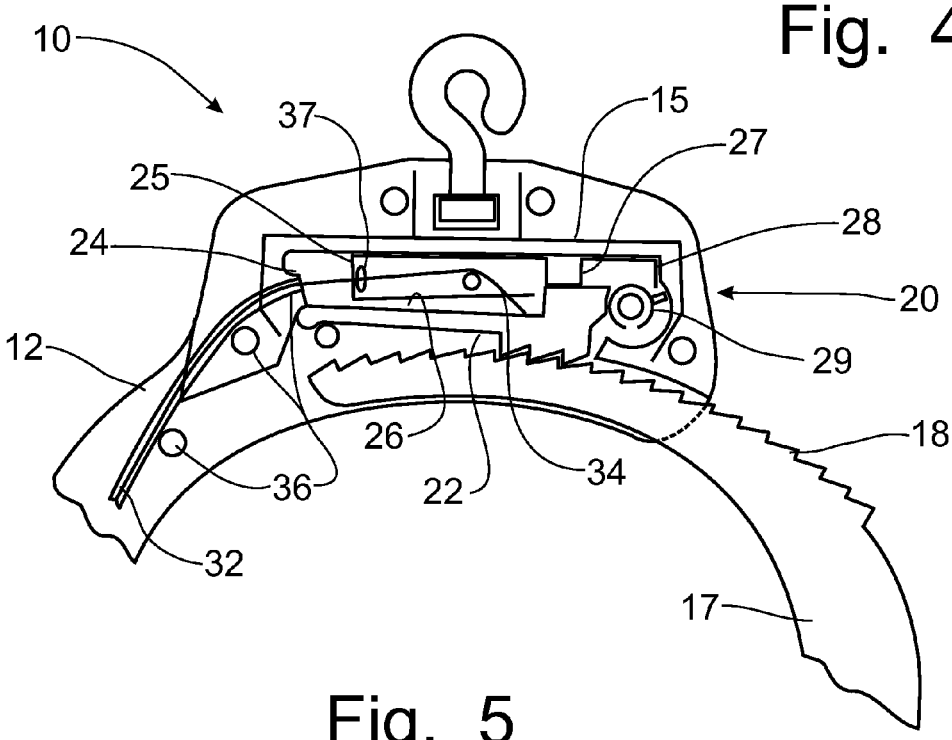
Fig. 5

Fig. 6
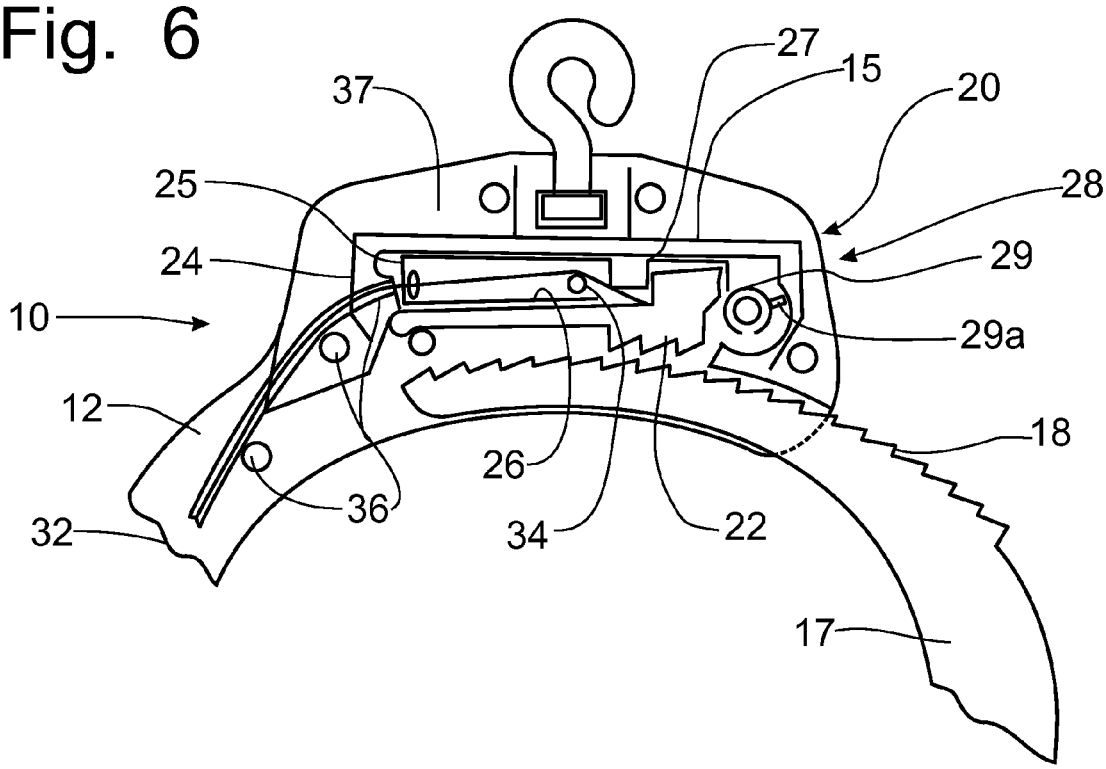
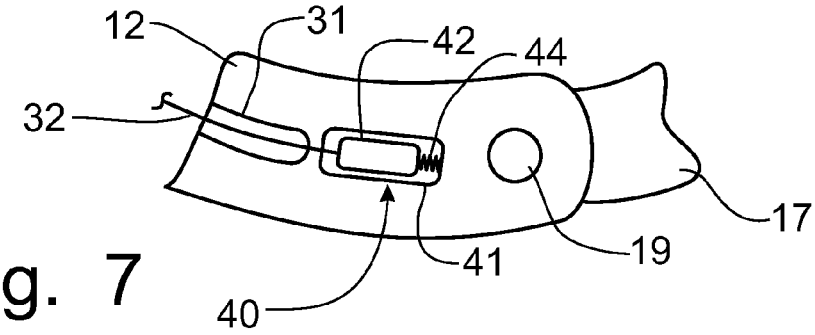
Fig. 7

Fig. 11
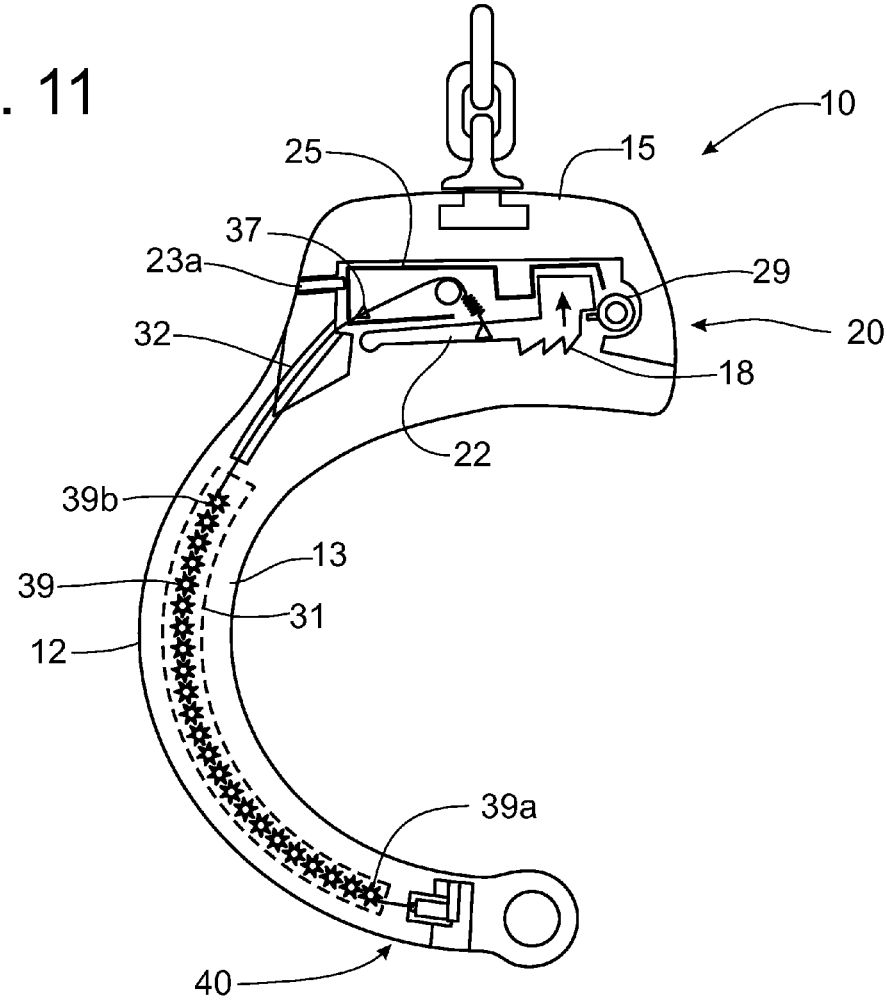
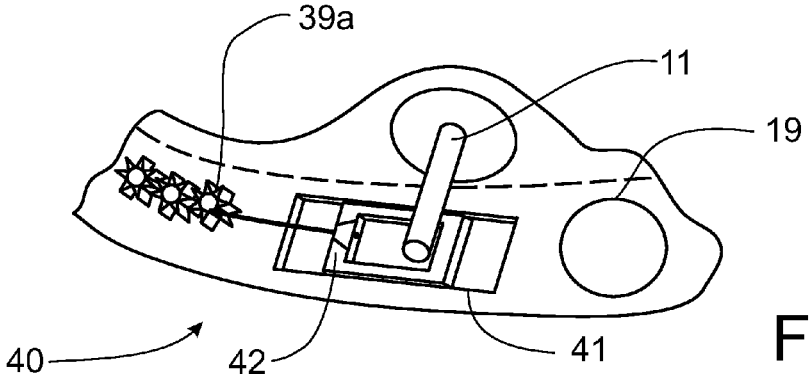
Fig. 12

Fig. 14
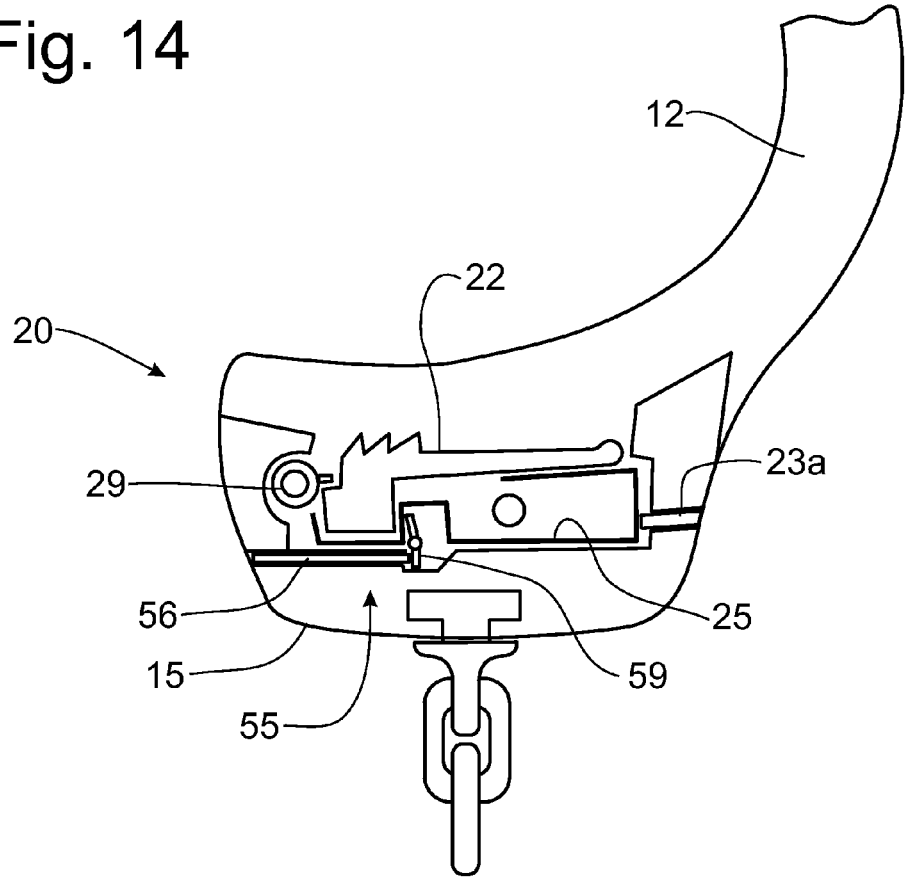
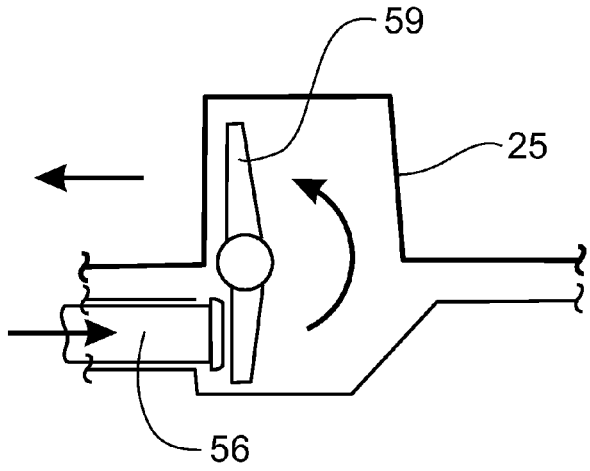
Fig. 15

Fig. 17
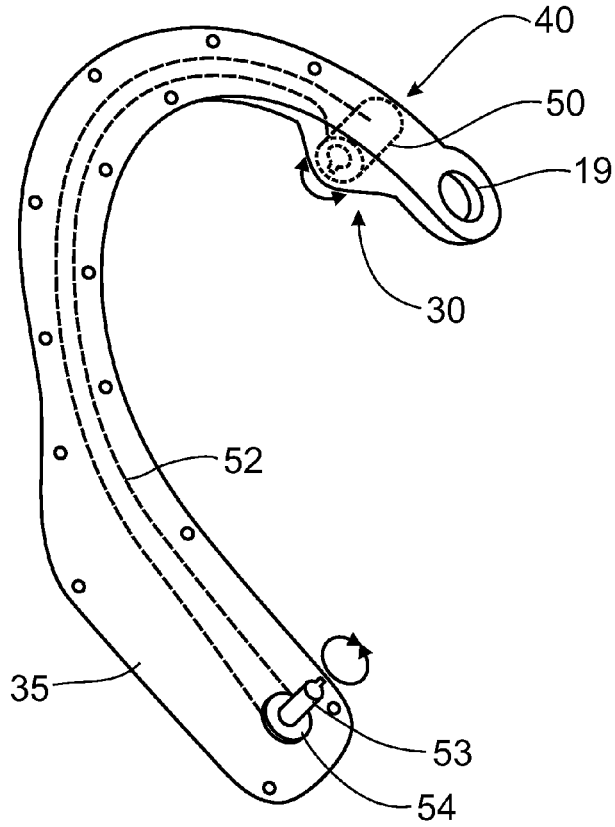
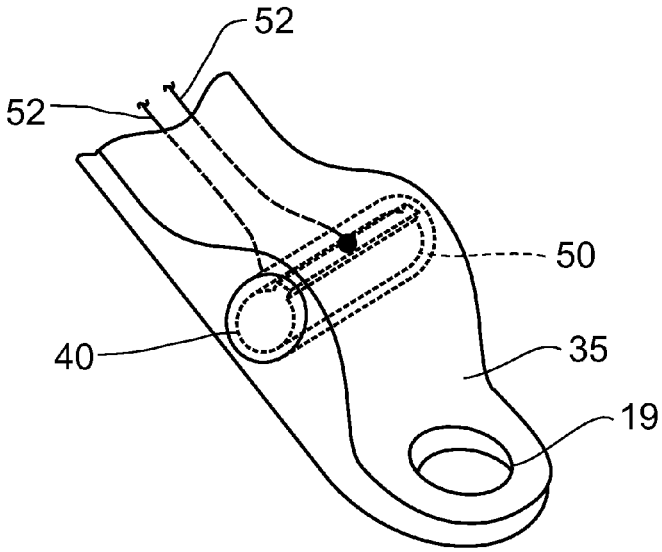
Fig. 18

REMOTE LOCK MECHANISM FOR HANDCUFFS AND OTHER SECURITY DEVICES

CROSS-REFERENCE TO RELATED APPLICATIONS

This application claims domestic priority on U.S. Provisional Patent Application Ser. No. 61/326,737, filed on Apr. 22, 2010, the content of which is incorporated herein by reference.

FIELD OF THE INVENTION

The present invention generally relates to security devices, such as handcuffs and shackles and, more particularly, to a remote locking mechanism to permit the security device to be unlocked from an outside surface of the security device.

BACKGROUND OF THE INVENTION

As is reflected in U.S. Pat. No. 4,574,600, issued on Mar. 11, 1986, to Warren Moffett, lockable handcuffs include a fixed arcuate jaw having opposed face members and a movable arcuate jaw that is formed with a saw tooth ratchet on one side thereof. The movable arcuate jaw is pivotally attached to the fixed arcuate jaw so as to be movable relative thereto in a manner that will pass the movable jaw between the two face members. If nothing is captured between the fixed and movable jaws, the movable jaw can pivot about its pivotal connection with the fixed jaw, passing between the two face members of the fixed jaw. The handcuff also includes a locking mechanism that has a mating ratchet member with a reverse saw tooth configuration that is pivotally supported within the lock mechanism between an engagement position and a non-engagement position with the ratchet on the movable jaw. Typically, the mating ratchet member is spring-loaded into engagement with the movable jaw as the movable jaw passes by the locking mechanism. A slidable clip is movable into a double lock position in which the clip restricts the mating ratchet member from moving out of the engagement position.

In operation, the movable jaw is moved into engagement with the locking mechanism to encircle the wrist of the person to be restrained. The saw tooth pattern of the ratchet on the movable jaw and the reverse saw tooth configuration of the mating ratchet member in the lock mechanism allows the ramp portions to cam the mating ratchet member away from the movable jaw into the non-engagement position one tooth at a time with the mating ratchet member dropping into engagement position on each tooth due to the spring load on the mating ratchet member. As a result, the movable jaw can move inwardly to tighten against the wrist of the person being restrained, but cannot move outwardly to release the movable jaw from the locking mechanism due to the spring load on the mating ratchet member and the interference between the teeth on the movable jaw and the mating ratchet member.

Most handcuffs are then capable of being double-locked, which refers to a fixing of the mating ratchet member into the engagement position so that the movable jaw cannot move either inwardly or outwardly. To accomplish the double-lock operation, a slidable member, such as the movable clip shown in the aforementioned U.S. Pat. No. 4,574,600, is moved into a position that interferes with the pivotal movement of the mating ratchet member. As long as the clip is in the interfering, or double lock, position, the mating ratchet member is secured in the engagement position and cannot yield against the cam action induced by the sliding ramps of the mating saw tooth ratchets. Accordingly, the movable jaw is fixed in the selected position and cannot be released until the clip is moved into a position that will permit a pivoting of the mating ratchet member. That movement is induced by the lock key that often is turned in one direction to first move the clip out of the interfering position and then turned in the other direction to move the mating ratchet member into the non-engagement position to allow the movable jaw to be pulled outwardly and release the wrist of the person being restrained.

As can be seen in the aforementioned U.S. Pat. No. 4,574,600, the lock mechanism of a handcuff is located at the location where the two handcuffs are attached to one another. Thus, when applied to the wrists of the person being restrained, the lock mechanism on each handcuff is located between the corresponding wrists of the person being restrained. Accordingly, to release the handcuffs from a person being restrained, the officer bearing the lock key generally needs to be positioned directly in line with the center portions of the handcuffs to be able to access the keyhole and manipulate the locking mechanism in order to release the double-lock mechanism and the movable jaw. Furthermore, the officer's hands need to be positioned between the wrists of the person being restrained. This positioning of the officer, particularly when the hands of the person being restrained are in front of that person, raises security and safety issues. Although U.S. Pat. No. 7,062,943, granted on Jun. 20, 2006, to Kevin Parsons, et al, provides a two-sided key release mechanism for handcuffs, both keyholes are on opposite sides of the lock housing and the officer operating the handcuffs still has to reach between the restrained person's wrists to unlock the handcuffs.

An embodiment of a double lock mechanism that prevents the movable jaw of the handcuff to be further tightened on the wrist of the person being restrained is shown in U.S. Pat. No. 6,672,116. A different embodiment of a double lock mechanism is disclosed in U.S. Pat. No. 7,316,136, issued to Kevin Parsons on Jan. 8, 2008. Other double lock mechanisms are known in the art that provide a spring clip that slides into an interfering position with respect to the ratchet pawl that locks the ratchet pawl against the movable jaw of the handcuff. It would be desirable to provide a release mechanism of the double lock apparatus that can be actuated on either opposing transverse side of the lock housing so that the orientation of the handcuffs to permit access to the double lock release is not a prerequisite to the utilization of the handcuffs to restrain a person.

It would be desirable to provide a remote lock mechanism that would be positioned on the handcuff at a location that is preferably on an outer portion of the handcuff when used to secure a person being restrained so that the officer unlocking the handcuffs does not have to locate his or her hands between the wrists of the person being restrained, and does not need to stand in front of the person being restrained.

SUMMARY OF THE INVENTION

It is an object of this invention to overcome the aforementioned disadvantages of the prior art by providing a remote lock mechanism for handcuffs and other security devices.

It is another object of this invention to provide a lock mechanism for handcuffs that is located near the pivot connection between the fixed portion and the movable portion of a handcuff.

It is a feature of this invention that the remote lock mechanism is operably connected to the lock apparatus positioned to engage the ratchet end of the movable portion of the handcuff.

It is an advantage of this invention that the officer operating the handcuffs does not have to position his or her hands between the wrists of the person being restrained in order to unlock the handcuffs.

It is still another object of this invention to provide a remote lock mechanism for handcuffs that is operable to both release the double lock mechanism and the lock mechanism with reverse movements of the key in the remote lock mechanism.

It is another feature of this invention that the movement of the key in the remote lock mechanism will cause a corresponding movement of the lock tumbler in the lock apparatus in the handcuff.

It is still another feature of this invention that the opposing movements of the key in the remote lock mechanism are operable to release the double lock mechanism and the lock mechanism of the handcuff.

It is another advantage of this invention that the officer operating the handcuff lock mechanism has a greater measure of control over the movement of the person being restrained by the handcuffs.

It is yet another object of this invention that the double lock mechanism can be disengaged by a toggle device pivoted by contact from a push rod.

It is yet another feature of this invention that the lock housing is provided with double lock push rods on opposing transverse sides thereof to slide the spring clip into an interfering position.

It is still another advantage of this invention that the officer applying handcuffs to restrain a person does not have to be concerned about orientation of the handcuffs before application so that the double lock mechanism is properly positioned for subsequent actuation.

It is yet another object of this invention to provide a remote lock mechanism for handcuffs which is durable in construction, inexpensive of manufacture, facile in assemblage, and simple and effective in use.

These and other objects, features and advantages can be accomplished by a remote lock mechanism provided on a handcuff to allow the unlocking of the handcuff by insertion of the key in the remote lock mechanism. The remote lock mechanism is located adjacent the pivot connecting the movable portion of the handcuff to the fixed portion and, thus, can be operated when the handcuffs are used to restrain a person without the officer's hands being placed between the wrists of the person being restrained. The motion corresponding to the rotation of the key in the remote lock mechanism is transferred to the handcuff lock mechanism to retract the ratchet pawl away from the movable portion of the handcuff. In one embodiment, the remote lock mechanism utilizes a tumbler that causes opposing rotation of the conventional lock mechanism to first release the double lock mechanism and then retract the ratchet pawl with opposing rotations of the key in the remote lock mechanism.

BRIEF DESCRIPTION OF THE DRAWINGS

The advantages of this invention will be apparent upon consideration of the following detailed disclosure of the invention, especially when taken in conjunction with the accompanying drawings wherein:

FIG. 3 is a top plan view of the handcuff shown in FIG. 1 with the movable jaw pivoted into engagement with the fixed jaw and the locking mechanism, an alternative remote lock opening being depicted;

FIG. 4 is an end elevational view of the handcuff shown in FIG. 3;

FIG. 5 is an enlarged partial cross-sectional view of the locking mechanism shown in FIG. 2, the components being shown in a double-lock position;

FIG. 6 is an enlarged partial cross-sectional view of the locking mechanism similar to that shown in FIG. 5, but with the components being unlocked by the remote unlock mechanism according to the principles of the instant invention;

FIG. 7 is an enlarged plan view of the shuttle member at the remote unlock mechanism as shown in FIG. 2;

FIG. 11 is a top plan view of a fixed jaw portion of a handcuff incorporating another embodiment of the instant invention;

FIG. 12 is an enlarged perspective detail view of the secondary keyhole according to the embodiment of the invention shown in FIG. 11;

FIG. 14 is an enlarged partial cross-sectional view of an alternative embodiment of the locking apparatus incorporating a pivoted toggle to release the double lock mechanism;

FIG. 15 is an enlarged detail view of the portion of the lock apparatus shown in FIG. 14 utilizing a pivoted toggle;

FIG. 17 is a perspective view of the underside of the overlying plate incorporating the transfer mechanism for the remote lock mechanism shown in FIG. 16; and FIG. 18 is an enlarged detail view of the key actuator shown in FIG. 17.

DETAILED DESCRIPTION OF THE PREFERRED EMBODIMENT

Figure 1:
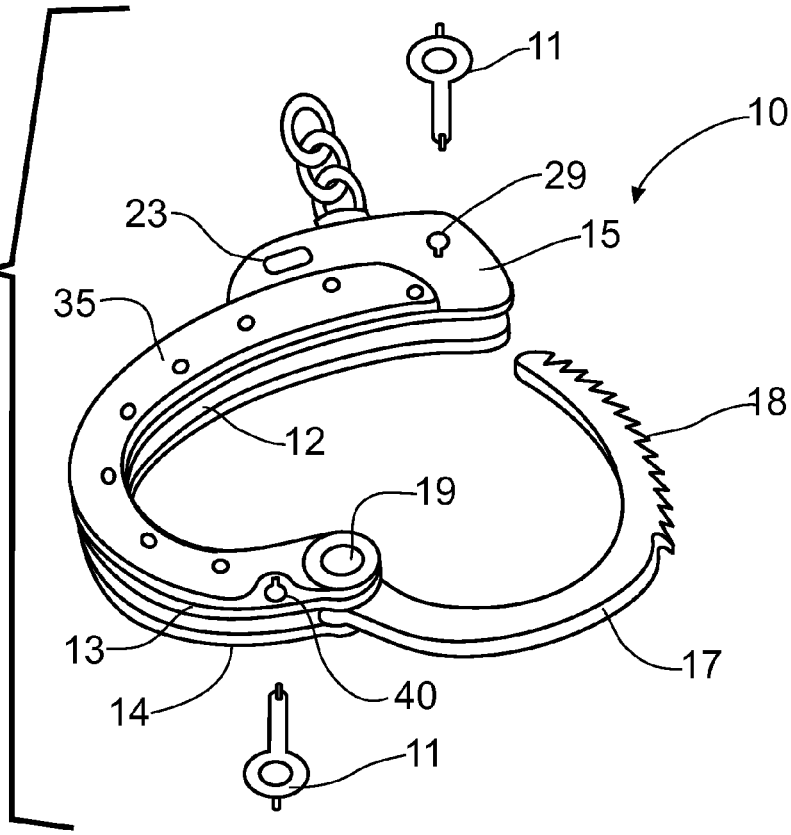
FIG. 1 is a perspective view of a handcuff incorporating the principles of the instant invention, the movable jaw being opened from the fixed jaw and representative lock keys being positioned above the alternative keyholes for unlocking the handcuff.
Figure 2:
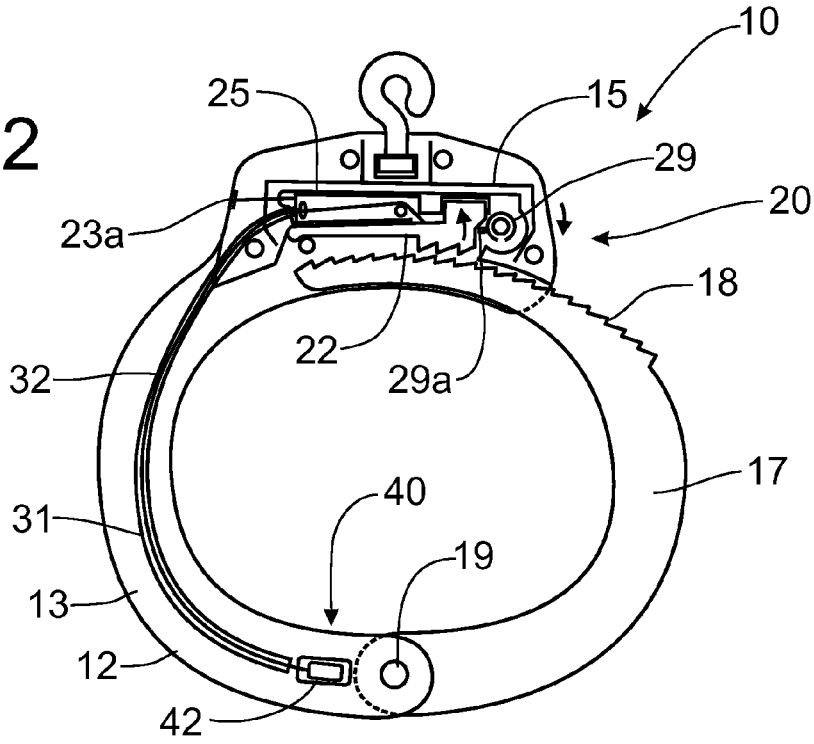
FIG. 2 is a top plan view of the handcuff shown in FIG. 1 with the cover plate on the fixed jaw and a portion of the outer cover of the locking mechanism being removed to view the instant invention.

Referring to FIGS. 1-7, a handcuff incorporating the principles of the instant invention can best be seen. One skilled in the art will recognize that the drawings depict only a single handcuff. Handcuffs come in pairs that are fastened together by a chain or tether that interconnects a connecting member on each handcuff. Accordingly, the description below is offered in conjunction with only one handcuff, although one skilled in the art will recognize that both handcuffs of each pair would be similarly constructed so as to provide the user of the handcuffs a safer means by which the handcuffs can be unlocked with each handcuff being unlocked independently.

Each handcuff 10 is constructed with a fixed arcuate jaw 12 having opposed face members 13, 14 and a housing 15 for the lock mechanism 20. A movable arcuate jaw 17 is formed with a saw tooth ratchet 18 on one side thereof and is pivotally connected by a pivot 19 to the end of the fixed jaw 12 at the end thereof distal from the housing 15. The pivotal movement of the arcuate jaw 17 in one direction, corresponding to the insertion of the tip of the movable jaw 17 into the lock housing 15, allows the arcuate jaw 17 to pass between the opposing face members 13, 14 of the fixed jaw 12 and completely circle around the pivot 19 unless an object, such as a wrist, is captured between the fixed and movable jaws 12, 17.

The lock housing 15 encloses a locking mechanism 20, such as is depicted in the drawings, that has a mating ratchet member 22 formed with a reverse saw tooth ratchet that is pivotally supported within the lock mechanism between an engagement position and a non-engagement position corresponding to the engagement of the ratchet on the movable jaw. One skilled in the art will recognize that handcuffs can have different locking mechanisms 20, but typically utilize a movable ratchet member that is selectively engagable with the ratchet 18 on the movable jaw 17 to selectively secure the position of the movable jaw 17 relative to the fixed jaw 12, and a second movable member that controls the ability of the movable ratchet member to move into and out of engagement with the ratchet 18 of the movable jaw 17. In the representative locking mechanism 20 shown in the drawings, the ratchet member 22 pivotally supported by the lock housing 15 to move generally vertically between an engagement position shown in FIG. 5 and a non-engagement position shown in FIG. 6. The pivoted ratchet member 22 is formed with a saw tooth ratchet that is oriented in reverse of the ratchet 18 on the movable jaw 17. As a result, the ramp portions of the two ratchets can slide over one another so long as the ratchet member 22 is free to pivot away from the movable jaw 17.

However, the movable jaw 17 can only be retracted from the lock housing 15 if the ratchet member is moved out of engagement with the movable jaw 17, thus allowing a freedom of movement for the movable jaw 17. To control the pivotal movement of the ratchet member 17, the lock mechanism 20 includes a clip member 25 that is operable to move into an interference position with respect to the ratchet member 22 and prevent the ratchet member 22 from pivoting away from the movable jaw 17. This interference position of the clip member 25, which is shown in FIG. 5, is typically referred to as double-locking the handcuffs 10. When the ratchet member 17 is forced into engagement with the ratchet 18 on the movable jaw 17, the movable jaw 17 cannot move in either direction. In the embodiment of the handcuff 10 shown in the drawings, the clip 25 also serves as a spring to urge the ratchet member 22 toward engagement with the movable jaw 17 as the leg 26 exerts a spring force on the ratchet member 22.

The clip 25 is also formed with a bent portion 27 that is sized to fill the space between the top of the ratchet member 22 and the top of the housing 15 when the clip 25 is moved into the interfering position as shown in FIG. 5. When the clip I 25 is in this interfering position, the bent portion 27 prevents the ratchet member 22 from disengaging the movable jaw 17. When the clip 25 is moved into the non-interfering position as shown in FIG. 6, the bent portion 27 is cleared from the ratchet member 22 which enables the ratchet member 22 to rise above the ratchet 18 of the movable jaw 17 whether as a result of ratchet member 22 riding over the ramps of the ratchet 18, or as a result of the operation of the lock key 11, as will be described in greater detail below.

The lock housing 15 also incorporates a keyhole 29 sized and shaped to mate with the lock key 28, and located to engage both the slidable clip 25, when in the interfering position, and the pivotable ratchet member 22. The keyhole 29 is formed with an actuator lever **29*a* that will engage the actuator leg 28 of the slidable clip member 25 when the key 11 is rotated counter-clockwise (as viewed in FIG. 5) to push the clip 25 laterally until the clip 25 is shifted to the end of the chamber 24 housing the clip 25, at which position the bent portion 27 is in the non-interfering position as depicted in FIG. 6. Once the bent portion 27 is moved to the non-interfering position, the lock key 11 can then be turn clockwise (as viewed in FIG. 5) so that the actuator lever 29*a* will engage the ratchet member 22 and force the ratchet member 22 to pivot upwardly relative to the movable jaw 17 against the spring force exerted by the spring leg 26. While the ratchet member 22 is held upwardly in the non-engagement position by the lock key 11, the movable jaw 17 can be retracted out of the lock housing 15 to release the person being restrained by the handcuffs 10**.

Figure 8:
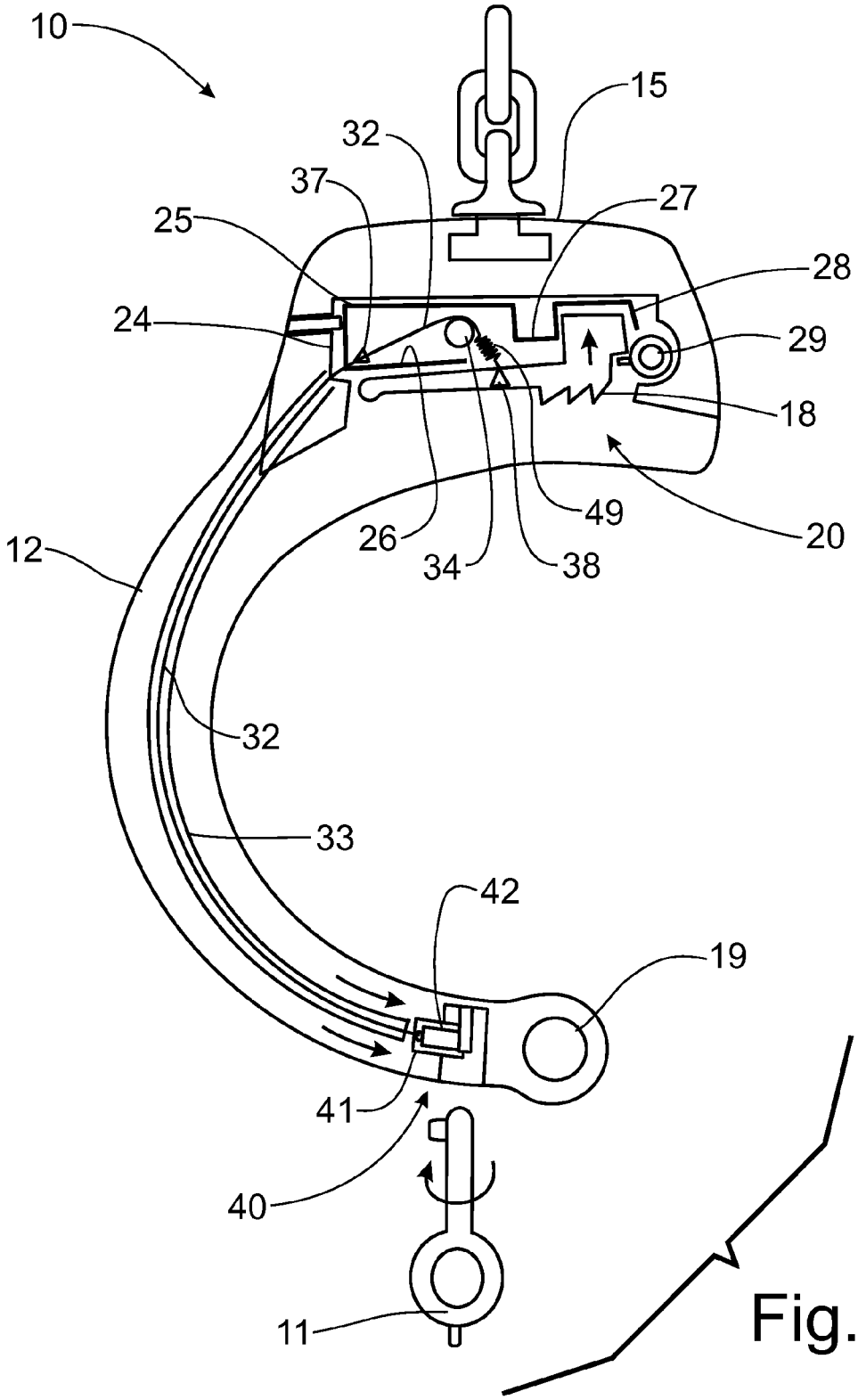
FIG. 8 is a top plan view of a fixed jaw of a handcuff with portions broken away to depict a second embodiment of the instant invention.

From a safety standpoint, unlocking the handcuffs 10 would be accomplished better if the keyhole 29 were not in the lock housing 15 where engagement with the slidable clip member 25 and the ratchet member 22 is easily attained. Such a remote unlock mechanism 30 is depicted in FIGS. 1-7. The remote unlock mechanism 30 includes a secondary keyhole 40 located on the fixed jaw 12 adjacent the pivot 19 between the fixed and movable jaws 12, 17. In this position, the secondary keyhole 40 can be oriented to the outside of the wrists of a person being restrained by the handcuffs. The remote unlock mechanism 30 includes a channel 31 machined into either the outside surface of one of the face members 13 of the fixed jaw 12, which channel 31 is covered by a plate 35 secured, such as by welding, to the outside surface of the face member 13, or preferably machined into the underside of the cover plate 35 so that only minimal modifications to the structure of the existing handcuff needs to be made. A motion transfer device, such as a cable or wire 32, is seated within the channel 31 for movement within the channel 31 as will be described in greater detail below. A series of pins or roller bushings 36 may be inserted within the channel 31 to help guide the movement of the wire 32. Alternatively, the channel 31, as is shown in FIGS. 8 and 9, can simply house a push-pull cable 32 having a wire guide tube 33 supported therein with the wire 32 movable within the guide 33.

At the lock housing 15, an opening 16 is formed in communication with the channel 31 for the passage of the wire 32 from the channel 31 into the lock housing 15. The wire continues into the chamber 24 housing the slidable clip 25 and through the clip 25, around a roller bushing 34 positioned to allow clearance for the movement of the slidable clip 25 when moving into the non-interfering position described above. The wire 32 is provided with a stopper grommet 37 located on the interior side of the slidable clip 25. The stopper grommet 37 is fixed to the wire 32 and moves therewith. The end of the wire 32 is attached to the pivotable ratchet member 22.

Figure 9:
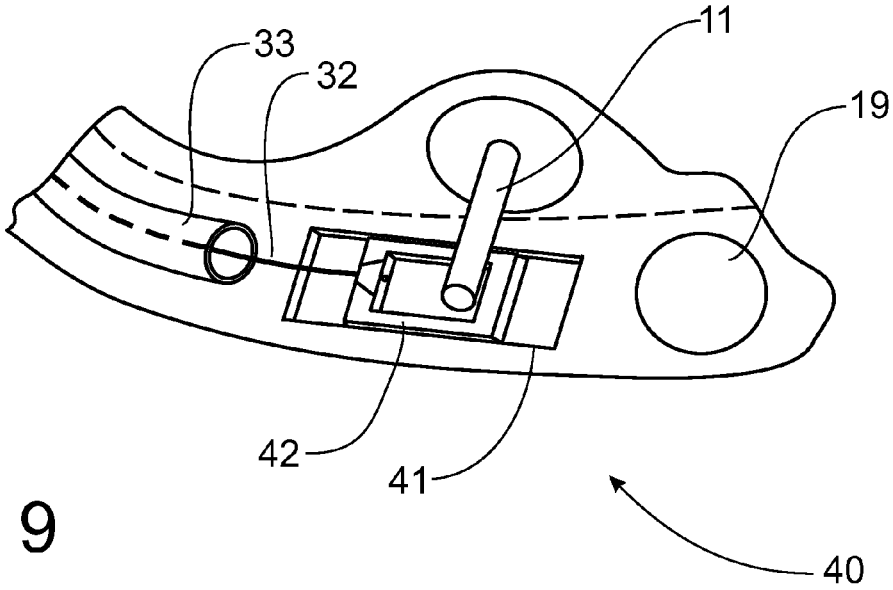
FIG. 9 is an enlarged perspective detail view of the secondary keyhole and the unlock mechanism therein.

The secondary keyhole 40, as is best seen in FIGS. 7 and 9, with respect to the two embodiments, includes a chamber 41 in which is slidably mounted a wire slide block 42 that is spring-biased away from the pivot 19 by a spring 44 located between the wire slide block 42 and the distal end of the chamber 41. The wire 32 is affixed to the wire slide block 42 so as to be movable in unison. The wire slide block 42 is positioned within the chamber 41 to be accessed by the lock key 11 when inserted into the secondary keyhole 40. Accordingly, the lock key 11 is operable to affect a sliding movement of the wire slide block 42 against the biasing force exerted by the spring 44. Accordingly, when the lock key 11 is inserted into the secondary keyhole 40 and turned in the appropriate direction, the key 11 pushes against the end of the wire slide block 42 and pulls the wire slide block 42 toward the pivot 19 while compressing the spring 44. When the key 11 is released, the spring 44 returns the wire slide block 42 against the opposing end of the chamber 41.

The above-described movement of the wire slide block 42, as induced by the lock key 11, causes a corresponding movement of the wire 32 within the channel 41 and within the clip chamber 24 that ultimately pulls upwardly on the ratchet member 22. One skilled in the art will understand that a small amount of slack in the cable/wire 32 needs to be provided within the chamber 24 to allow for a movement of the clip 25 before the wire 32 pulls on the ratchet member 22 as the bent portion 27 of the clip 25 has to clear the ratchet member 22 before the ratchet member 22 can be moved. Thus, the movement of the wire slide block 42 against the spring 44 pulls on the wire 32 and draws the stopper grommet 37 against the clip member 25 to draw the clip member 25 away from engagement of the ratchet member 22. When the bent portion 27 clears the ratchet member 22, the wire lifts upwardly on the ratchet member 22 to pull the ratchet member 22 into the non-engagement position, as is depicted in FIGS. 6 and 8.

Figure 10:
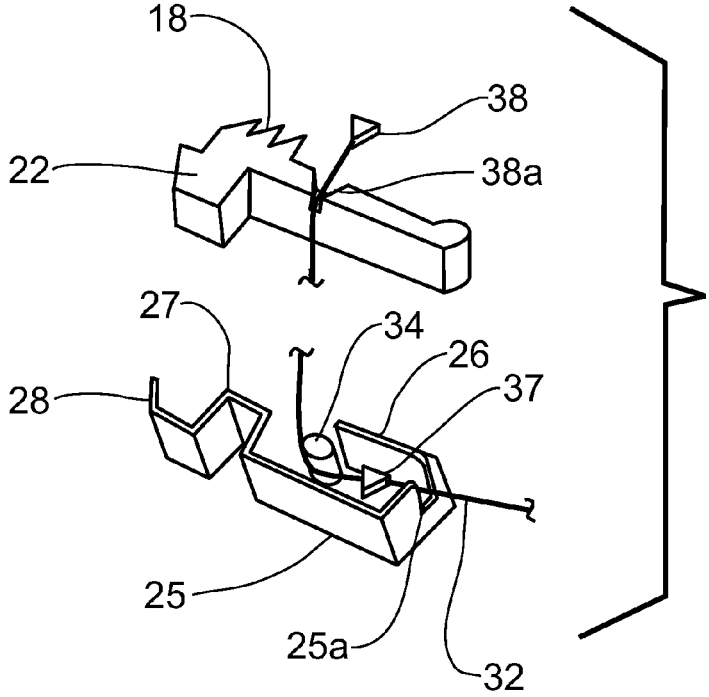
FIG. 10 is an enlarged perspective detail view of the ratchet member and clip member modified according to the principles of the instant invention.

In the embodiment depicted in FIGS. 8-10, the cable 32 incorporates a lost motion spring 49 within the chamber 24. The end of the cable 32 has a cable wedge 38 affixed thereto to wedge into the notch 38*a* when the cable 32 is pulled outwardly by the operation of the wire slide block 42. Similarly, the stopper grommet 37 is in the form of a wedge member that lodges in the notch 25*a* formed in the spring clip member 25 to pull the spring clip 25 out of interference with the movement of the ratchet member 22. The notches 38*a* and 25*a* are formed in the ratchet member 22 and the spring clip member 25, respectively, to allow for the passage of the wire cable 32 and the corresponding engagement of the cable wedges 37 and 38. Thus, when the lock key 11 is inserted into the secondary keyhole 40 and rotated to engage the wire slide block 42 to pull on the wire cable 32, the stopper grommet 37 pulls on the interior of the spring clip member 25 to shift the spring clip member 25 to the end of the chamber 24.

This movement of the wire cable 32 also pulls the cable wedge 38 into engagement with the notch 38*a* in the ratchet member 22, but the cable 32 cannot move the ratchet member 22 until the clip member 25 is moved to the end of the chamber 24. While the cable 32 is moving the spring clip member 25 and the ratchet member 22 is unable to move, the lost motion spring 49 extends to accommodate the movement of the wire cable 32 without moving the ratchet member. Once the clip member 25 has cleared past the point of interference with the ratchet member 22, the energy stored in the lost motion spring 49 will cause the upward pivotal movement of the ratchet member 22 without requiring any further movement of the wire cable 32. The lost motion spring 49 has to be sufficiently strong to overcome the biasing force exerted by the spring leg 26 to urge the ratchet member 22 back into the engagement position.

Once the lock key 11 has been removed, the wire cable 32 is allowed to return to the previous position, which is accomplished by the movement of the ratchet member 22 due to the biasing force exerted by the spring leg 26, as the cable wedge 38 engaged in the notch 38*a* will pull the cable 32 along with the ratchet member 22, although a supplemental spring 44 between the wire slide block 42 and the chamber 41 could assist in affecting the return movement of the cable 32. With this return movement of the cable 32, the stopper grommet 37 moves inwardly away from engagement with the interior of the spring clip member 25 and the relaxed lost motion spring 49 simply follows along with the movement of the cable 32. When the spring clip member 25 is manually returned to the double-lock, interference position, the interior surface of the spring clip member 25 moves back into engagement with the stopper grommet 37 for a subsequent movement of the clip member 25 the next time the lock key 11 is operated in the remote unlock mechanism 30.

Accordingly, the secondary lock mechanism 30 affects a release of the double-lock function of the handcuff 10 from a single movement of the lock key 11. Once the lock key 11 is released at the secondary keyhole 40, the clip member 25 will remain shifted out of engagement with the ratchet member 22, but the spring load provided by the clip member 25 on the ratchet member 22 will return the ratchet member 22 to the engagement position for a ratcheting engagement of the movable jaw 17 as described above until the clip member 25 is moved back into the interfering position by the engagement of the lock key 11 into the lock mechanism 20. The operation of the secondary unlock mechanism 30 is not effective to move the clip member back to the interfering position. Furthermore, the shifting of the clip member 25 into the interfering position will pull the wire 32 into the chamber 24 because of the stopper grommet 37 moves with the interior surface of the clip member 25, providing the requisite amount of slack within the chamber 24, or the utilization of the lost motion spring 49 as depicted in FIG. 8.

In operation, the handcuffs 10 work in the same manner as is previously known in the art. The movable jaw 17 is inserted into the fixed jaw 12 where the ratchet member 22 engages the ratchet portion 18 of the movable jaw 17 to secure the wrists of the person being restrained, which are captured between the fixed and movable jaws 12, 17 of the handcuffs 10. The clip member 25 is then slid into the interfering position by inserting the lock key 11 into the slot 23 where the bent portion 27 blocks the upward movement of the ratchet member 22 to double-lock the handcuffs 10. Alternatively, a push rod 23*a* positioned on the side of the lock housing 15, as represented in FIG. 7, can be used to push the clip member 25 into the interfering position.

The unlocking of the handcuffs 10 can be accomplished in the conventional manner by inserting the lock key 11 into the keyhole 29 in the lock housing 15 and turning the lock key 11 in one direction to shift the clip member 25 and then reversing the direction of rotation of the lock key 11 to engage the ratchet member 22 to force the lifting thereof against the spring force exerted by the clip member 25 and disengage the ratchet portion 18 of the movable jaw 17. At this point, the movable jaw 17 can be retracted from the fixed jaw 12 and the lock housing 15. As noted above, the secondary or remote unlock mechanism 30 can be utilized to unlock the handcuffs 10 by rotating the lock key 11 in the secondary keyhole 40 to push the wire slide block 42 against the spring 44, which pulls on the clip member 25 through the stopper grommet affixed to the wire 32 connected to the wire slide block 42 and transfers the motion to lift the ratchet member 22 into the non-engagement position.

An alternative arrangement of the motion transfer apparatus can be seen in FIGS. 11-12 in which the channel 41, whether formed in the outer surface of the face member 13 or in the interior surface of the cover plate 35, is filled with a series of intermeshing gears 39 that will transfer the movement of the first gear 39*a* as induced by an engaged lock key 11 to the final gear 39*b* adjacent the lock housing 15, or into a wire slide block 42 which is connected in an eccentric manner to the final gear 39*b* by a wire as is depicted in FIG. 12. Similar to the arrangements described above with respect to FIGS. 1-10, a wire or cable 32 is connected to the final gear 39*b* to transfer motion to pull on the clip member 25 and then the ratchet member 22 to affect a release of the ratchet member 22 from the movable jaw 17. One skilled in the art will recognize that the exact geometry of the respective components shown in FIGS. 1-12 may not be accurately depicted, but can be finally designed to operate as described above.

Figure 13:
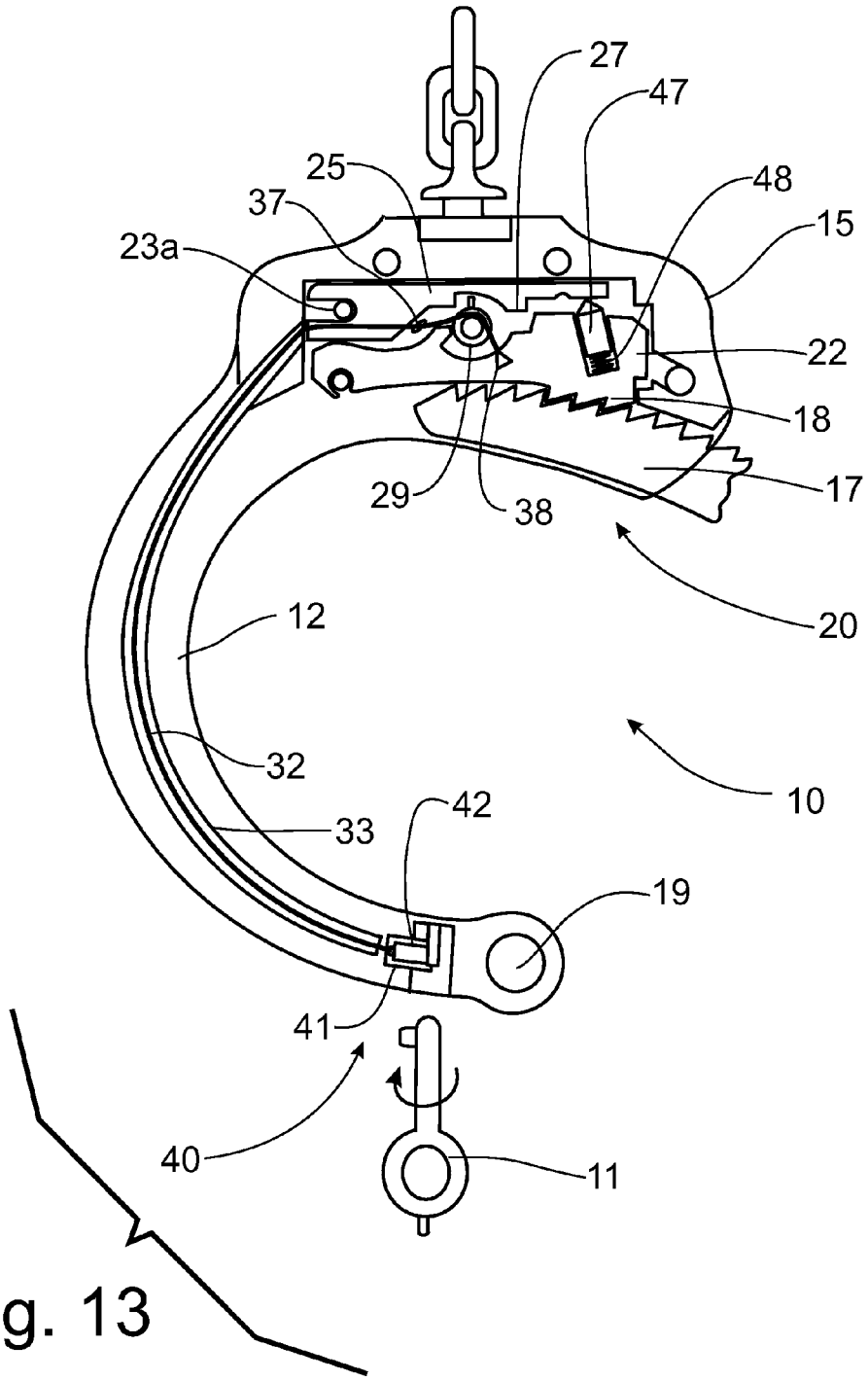
FIG. 13 is a top plan view of a fixed jaw portion of a handcuff incorporating another embodiment of the instant invention.

A different type of handcuff locking mechanism 20 is shown in FIG. 13; however, the principles of the instant invention can be applied to enable the double locking mechanism 20 to be remotely unlocked by the remote unlocking mechanism 30. As with the other embodiments described above, the remote unlocking mechanism 30 has a secondary keyhole 40 adjacent the pivot 19 of the handcuffs connecting the movable jaw 17 to the fixed jaw 12. The remote unlocking mechanism 30 is actuated by a lock key 11 that affects a sliding movement of the wire slide block 42, which in turn pulls on the cable 32 to transfer movement to the lock mechanism 20.

The stopper grommet 37 pulls the clip member 25 laterally so that the bent ledge portion 27 of the clip member 25 is moved into a non-interfering position as is depicted in FIG. 13. The delayed pull on the ratchet member 22 can then lift the ratchet member 22 upwardly away from engagement with the ratchet portion 18 of the movable jaw 17 to allow the movable jaw 17 to be moved out of the lock mechanism 20. This configuration of handcuff lock mechanism 20 has a spring-loaded detent post 47 that serves to maintain a biasing force on the ratchet member 22 through the compression of the spring 48 below the post 47. The pull of the cable 32 on the ratchet member 22 after the clip member 25 has been shifted laterally to free the ratchet member 22 for movement will overcome the biasing force exerted by the spring 48 as long as the lock key 11 is engaged with the wire slide block 42 to operate the remote unlock mechanism 30. When the lock key 11 is released, the spring 48, through the engagement of the detent post 47 pushes the ratchet member 22 back into an engagement position. Accordingly, one skilled in the art will recognize that the principles of the instant invention can be applied to different configurations of lock mechanisms 20, so long as a sliding movement of one member frees the movement of a second member that disengages the movable jaw 17, which is accomplished through operation of the remote unlock mechanism 30.

Figure 16:
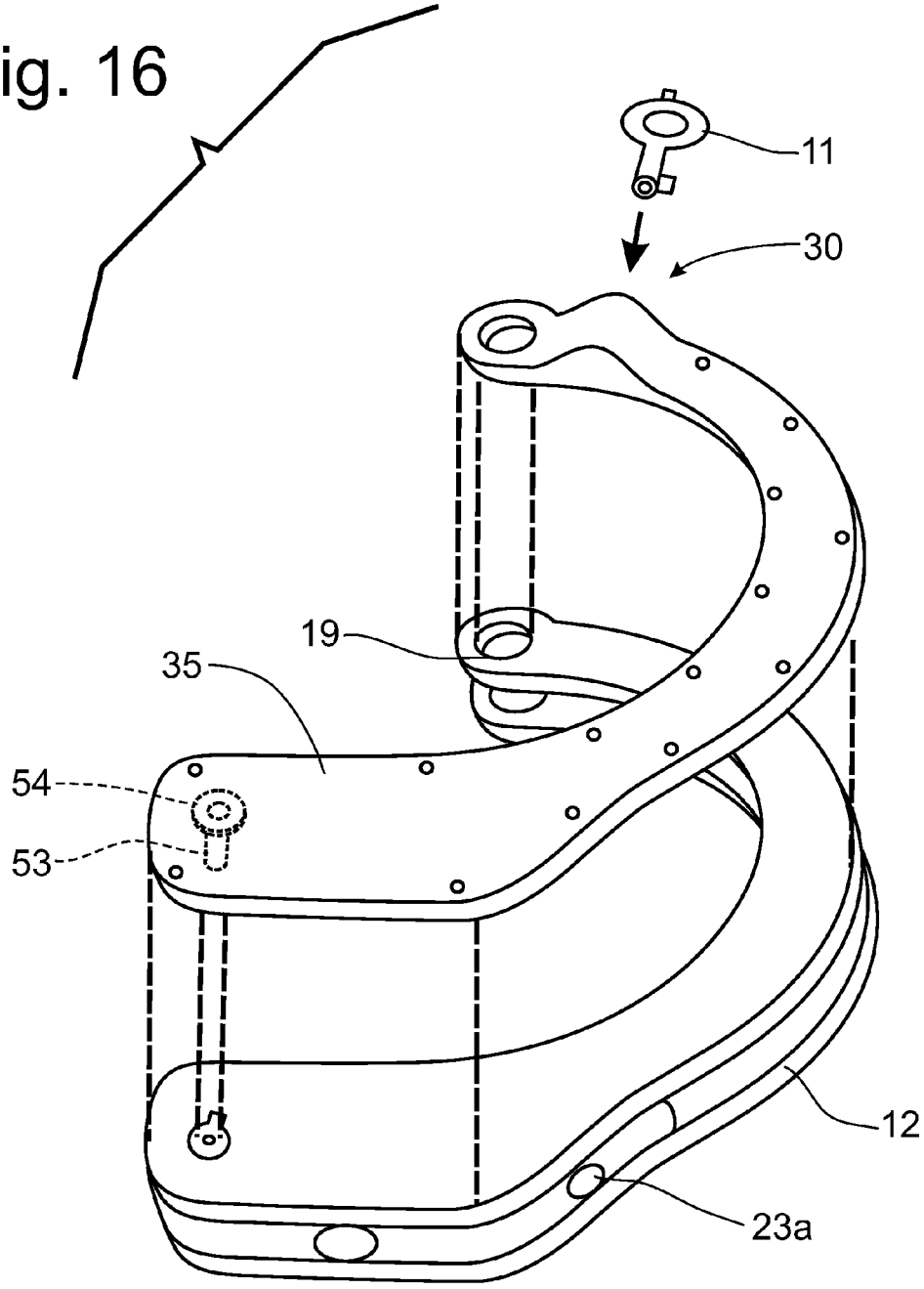
FIG. 16 is an exploded perspective view of an alternative remote lock mechanism operable to release the double lock mechanism and the lock mechanism in the handcuffs.

Another alternative embodiment of the remote unlock mechanism 30 is depicted in FIGS. 14-18. In this alternative embodiment, the operation of the key 11 in the remote unlock mechanism 30 is similar to the conventional operation of the key 11 in the lock apparatus 20 for conventional handcuffs. The key 11 turns a tumbler 50 corresponding to the secondary keyhole 40. A cable 52 is attached to the tumbler 50 on opposing sides thereof, as is best seen in FIGS. 16-18, and then entrained around a sprocket 54 on the stub shaft 53 at the opposing end of the cover plate 35, the cable 52 being encased within a channel (not shown) on the underside of the cover plate 35. In the alternative, the cable 52 could be in the form of a pair of push/pull cables that are appropriately attached to the sprocket 54 to cause rotation thereof. Thus, the movement of the tumbler 50, as induced by the key 11 being inserted therein and rotated, in one direction causes a rotation of the stub shaft 53 in a corresponding first direction, while the opposing rotation of the tumbler 50 will cause the stub shaft 53 to rotate in the opposite direction.

As a result, the operation of the remote unlock mechanism 30 is essentially the same as the conventional lock mechanism for handcuffs. In other words, the rotation of the key 11 in a first direction pushes the spring clip 25 out of the interfering position with respect to the ratchet member 22 and then allows the opposing rotation of the key 11 to lift the ratchet member 22 into a non-locked position that enables the ratchet end 18 of the movable jaw 17 to be extracted from the lock housing 15. As with the conventional lock mechanism 20, the initial rotation of the key 11 into the wrong direction will be ineffective to do anything with respect to the lock mechanism 20 as the spring clip 25 has to be moved into the non-interfering position before the ratchet member 22 can be lifted.

An alternative double lock mechanism 55 is also depicted in FIGS. 14 and 15. The push rod 56 is accessible from the opposite side of the lock housing from the conventional push rod 23*a*, and thus is movable in the wrong direction to directly push the spring clip 25 into the interfering position. To redirect the movement of the push rod 56, a toggle 59 is pivotally mounted within the lock housing 15 to be operable within the bent portion 27 of the spring clip 25. As is indicated in FIG. 16, the toggle 59 is operable to push the spring clip 25 into the interfering position above the ratchet member 22. The shifting of the spring clip 25 by the double lock release, as described above, will cause the toggle 59 to pivot backward and push the push rod 56 back out of the lock casing 15. With double lock actuators 23*a*, 56 on opposing sides of the lock housing 15, the spring clip 25 can be shifted into the interfering position from either side of the lock housing 15. Thus, an officer applying handcuffs to a person to be restrained thereby does not have to be concerned with the orientation of the handcuffs before applying them so that the double lock actuator is properly positioned for subsequent actuation. The double lock of the handcuffs can be actuated from either side of the lock housing 15.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention.

As an example, other security restraint devices, such as leg shackles, can also be constructed to incorporate a remote unlock mechanism 30 to enable the release of the restraint device in a manner similar to that described above. Furthermore, other motion transfer devices can be utilized in the security restraint devices, including the handcuffs 10 as shown in FIGS. 1-12, to transfer the movement of the lock key 11 in the secondary keyhole 40 and affect a release of the clip member 25 and the ratchet member 22, including a hydraulic apparatus as is known in the arts.

Having thus described the invention, what is claimed is:

1. A handcuff comprising:

a fixed portion carrying a pivot end and a lock housing at an opposing end remote from said pivot end;

a movable portion pivotally connected to said pivot and including a ratchet end remote from said pivot, said movable portion being configured to insert said ratchet end into said lock housing;

a lock apparatus located within said lock housing and being operable to engage said ratchet end of said movable portion to lock said ratchet end within said housing, said lock apparatus including a ratchet member movable between a lock position engaged with said ratchet end of said movable portion and an unlock position in which said movable portion is free to move without restriction from said ratchet member; and a remote unlock mechanism mounted on said fixed portion at a location spaced from said lock housing toward said pivot end, said remote unlock mechanism having a secondary keyhole that is operable to receive a handcuff key that selectively causes a motion transfer mechanism housed within said fixed portion to interconnect said secondary keyhole and said ratchet member to move said ratchet member in said lock housing into said unlock position.

2. The handcuff of claim 1 wherein said motion transfer apparatus transfers rotational motion of the handcuff key within the secondary keyhole to the ratchet member to cause movement thereof between the lock and unlock positions.

3. The handcuff of claim 2 wherein said remote unlock mechanism also includes a cover plate positionable over said fixed portion to incorporate said motion transfer apparatus.

4. The handcuff of claim 3 wherein said motion transfer apparatus includes a slide block supported in said cover plate adjacent said secondary keyhole and a cable housed within said cover plate and connected to said slide block so as to be linearly movable in conjunction with the rotation of the handcuff key within the secondary keyhole, said cable also being connected to said ratchet member to move the ratchet member into said unlock position in response to a corresponding movement of said slide block.

5. The handcuff of claim 3 wherein said motion transfer apparatus includes a tumbler associated with said secondary keyhole such that rotation of said handcuff key causes a corresponding rotation of said tumbler.

6. The handcuff of claim 5 wherein said tumbler is connected to a cable carried by said cover plate and entrained around a stub shaft to cause rotation of said stub shaft in response to a corresponding rotation of said tumbler, said stub shaft being engagable with said lock apparatus to cause rotational movement to move said ratchet member into said unlock position.

7. The handcuff of claim 6 wherein rotational movement of said tumbler in a first direction releases a double lock mechanism within said lock apparatus, while a subsequent rotation of said tumbler in an opposing second direction moves said ratchet member into said unlock position.

8. The handcuff of claim 7 wherein said double lock mechanism includes a spring clip slidable within said lock housing for movement between an interfering position in which said ratchet member is prevented from moving into said unlock position and a non-interfering position in which said ratchet member is free to move into said unlock position, said lock housing including a first push rod engagable with a pivoted toggle to cause said spring clip to move into said interfering position.

9. The handcuff of claim 8 wherein said lock housing includes a second push rod on an opposite side of said lock housing from said first push rod, said second push rod being engagable directly with said spring clip to push said spring clip into said interfering position.

10. A remote unlock mechanism for a handcuff having a fixed jaw carrying a pivot at one end and a lock housing at an opposing end; a movable jaw pivotally connected to said pivot and including a ratchet end remote from said pivot, said movable jaw being configured to insert said ratchet end into said lock housing; and a lock apparatus located within said lock housing and being operable to engage said ratchet end of said movable jaw to lock said ratchet end within said housing, said lock apparatus including a ratchet member movable between a lock position engaged with said ratchet end of said movable jaw and an unlock position in which said movable jaw is free to move without restriction from said ratchet member, comprising:

a secondary keyhole positioned on said fixed jaw outside of said lock housing for communication with a handcuff key, said secondary keyhole being spaced from said lock housing toward said pivot end;

a motion transfer mechanism operably associated with said secondary keyhole to transfer rotational movement of said handcuff key positioned within said secondary keyhole to operate said ratchet member located within said lock housing to selectively cause said ratchet member to move into said unlock position.

11. The remote unlock mechanism of claim 10 wherein said motion transfer mechanism comprises:

a movable member associated with said secondary keyhole; and a cable operably interconnecting said movable member and said ratchet member to transfer rotary motion associated with said handcuff key in said secondary keyhole to move said ratchet member into said unlock position.

12. The remote unlock mechanism of claim 11 further comprising a cover plate attachable to said fixed jaw to locate said secondary keyhole adjacent said pivot, said cover plate housing said cable between said cover plate and said fixed jaw.

13. The handcuff of claim 12 wherein said movable member of said motion transfer apparatus comprises a tumbler associated with said secondary keyhole such that rotation of said handcuff key causes a corresponding rotation of said tumbler, said cable being entrained around a stub shaft to cause rotation of said stub shaft in response to a corresponding rotation of said tumbler, said stub shaft being engaged with a primary keyhole associated with said lock apparatus.

14. The remote unlock mechanism of claim 13 wherein rotational movement of said tumbler in a first direction releases a double lock mechanism within said lock apparatus, while a subsequent rotation of said tumbler in an opposing second direction moves said ratchet member into said unlock position, said double lock mechanism including a spring clip slidable within said lock housing for movement between an interfering position in which said ratchet member is prevented from moving into said unlock position and a non-interfering position in which said ratchet member is free to move into said unlock position.

15. The remote unlock mechanism of claim 14 wherein said lock housing includes a first push rod on one side of said lock housing engagable with a pivoted toggle to cause said spring clip to move into said interfering position, and a second push rod on an opposing side of said lock housing to engage said spring clip directly for movement thereof to said interfering position.

16. In a handcuff having a fixed jaw carrying a pivot at one end and a lock housing at an opposing end; a movable jaw pivotally connected to said pivot and including a ratchet end remote from said pivot, said movable jaw being configured to insert said ratchet end into said housing; and a lock apparatus located within said lock housing and being operable to engage said ratchet end of said movable jaw to lock said ratchet end within said housing, said lock apparatus including a ratchet member movable between a lock position engaged with said ratchet end of said movable jaw and an unlock position in which said movable jaw is free to move without restriction from said ratchet member, and a spring clip movable between an interfering position in which said ratchet member is prevented from moving into said unlock position and a non-interfering position in which said ratchet member is allowed to move into said unlock position, the improvement comprising:

a first push rod supported on one side of said lock housing and being engagable with a pivoted toggle within said lock housing to move said spring clip into said interfering position when said push rod is moved into said lock housing; and a second push rod on an opposing side of said lock housing to engage said spring clip directly for movement thereof to said interfering position.

17. The handcuff of claim 16 further comprising:

a remote unlock mechanism including a cover plate supporting a secondary keyhole remote from said lock housing and adjacent said pivot; a movable member operably associated with said secondary keyhole; and a motion transfer apparatus operably interconnecting said movable member and said ratchet member to cause said ratchet member to selectively move into said unlock position.

18. The handcuff of claim 17 wherein said movable member comprises a rotatable tumbler incorporating said secondary keyhole, said motion transfer apparatus including a cable connected to opposing sides of said tumbler and being entrained around a stub shaft carried by said cover plate, said stub shaft being engagable with said lock apparatus such that a rotational movement of said tumbler in a first direction causes a sliding movement of said spring clip into said non-interfering position, while a subsequent rotation of said tumbler in an opposing second direction moves said ratchet member into said unlock position.

* * * * *